United States Patent [19]

De Laurentis

[11] 4,201,966

[45] May 6, 1980

[54] MAGNETIC CORE STRUCTURE

[75] Inventor: Angelo A. De Laurentis, South Pymatuning Township, Mercer County, Pa.

[73] Assignee: Westinghouse Electric Corp., Pittsburgh, Pa.

[21] Appl. No.: 935

[22] Filed: Jan. 4, 1979

[51] Int. Cl.[2] ..... H01F 27/24

[52] U.S. Cl. ..... 336/217

[58] Field of Search ..... 336/216, 217, 234, 233; 29/606, 607, 609

[56] References Cited

U.S. PATENT DOCUMENTS

| | | | |
|---|---|---|---|
| 3,153,215 | 10/1964 | Burkhardt et al. | 336/217 |
| 3,210,709 | 10/1965 | Ellis et al. | 336/217 |
| 3,477,053 | 11/1969 | Burkhardt et al. | 336/217 X |
| 3,504,318 | 3/1970 | Wilburn et al. | 336/217 X |
| 3,540,120 | 11/1970 | DeLaurentis et al. | 29/609 |
| 3,559,136 | 1/1971 | Specht et al. | 336/217 |
| 3,611,234 | 10/1971 | DeLaurentis et al. | 336/217 |
| 3,670,279 | 6/1972 | Millsop et al. | 336/217 |
| 3,743,991 | 7/1973 | Gumpper et al. | 336/217 |
| 3,895,336 | 7/1975 | Pitman | 336/217 |
| 3,918,153 | 11/1975 | Burkhardt et al. | 336/217 X |

*Primary Examiner*—Thomas J. Kozma
*Attorney, Agent, or Firm*—D. R. Lackey

[57] ABSTRACT

Magnetic core structure of the stacked type having outer legs, an inner leg, and top and bottom yokes formed of a plurality of stacked groups of layers of metallic laminations. The length dimensions of the leg and yoke laminations are varied in opposite directions from layer to layer within each group of layers, while maintaining the midpoints of the laminations in each leg and yoke portion in alignment. This arrangement offsets the ends of the leg and yoke laminations from layer to layer and provides a stepped lap joint between adjoining ends of the leg and yoke laminations. The relative locations of the leg and yoke laminations are selected to uniformly divide the voids formed at the inner corners of the magnetic core between the leg and yoke laminations within each group of layers of laminations.

2 Claims, 3 Drawing Figures

MAGNETIC CORE STRUCTURE

BACKGROUND OF THE INVENTION

1. Field of the Invention

This invention relates, in general, to magnetic core structures for electrical inductive apparatus, such as transformers, and, more specifically, to magnetic core structures of the stacked type.

2. Description of the Prior Art

U.S. Pat. No. 3,153,215, which is assigned to the assignee of the present application, discloses magnetic core structures of the stacked type which have stepped-lap joints between the mitered ends of the leg and yoke portions of the magnetic core. In a stepped-lap joint, the joints between the mitered or diagonally cut ends of the leg and yoke laminations, in each layer of the lamination, are incrementally offset from similarly located joints in adjacent layers, in a predetermined stepped or progressive pattern, with the joints being stepped at least three times in one direction before the direction is changed or the pattern repeated. The stepped-lap joint was found to substantially improve the performance of the magnetic core, compared to magnetic cores which utilize conventional butt-lap type joints, by lowering the core losses, lowering the exciting volt-ampere requirements, and lowering the sound level of the magnetic core. In general, the prior art stepped-lap joint arrangements, as shown in U.S. Pat. Nos. 3,153,215; 3,477,053; 3,504,318 and 3,540,120, all of which are assigned to the assignee of the present application, obtain the desired stepped relationship between diagonally cut ends of the laminations by providing laminations for each leg or yoke portion which have the same longitudinal dimension between the diagonally cut ends. The stepped relationship is achieved by incrementally offsetting the midpoints of the laminations of any stacked group of laminations.

In prior art magnetic cores having stepped-lap joints, the stepped-lap joint between the inner leg and the top and bottom yoke laminations is constructed by forming a V-shaped notch in each of the top and bottom yoke laminations. The V-shaped notch in the yoke laminations is incrementally shifted, from layer to layer, parallel to the longitudinal axis of the magnetic core such that the inner leg laminations, which are of equal length, are also incrementally shifted parallel to the longitudinal axis or length of the magnetic core. In this manner, the equal length laminations of the top and bottom yokes are horizontally shifted from layer to layer which uniformly distributes the stepped-lap joint between the leg and yoke laminations and results in a symmetrical core structure which provides superior electrical characteristics. However, there is an inherent difficulty in constructing a horizontal stepped-lap magnetic core due to the multiple spaced end points of the inner leg laminations which are hidden from the view of the operator during assembly of the core thereby necessitating longer assembly times.

It is also known to step the inner leg laminations in a vertical direction, as shown in U.S. Pat. Nos. 3,153,215 and 3,743,991, both assigned to the assignee of the present application. In this type of magnetic core structure, the equal length inner leg laminations are vertically distributed, parallel to the straight side of the inner leg, by progressively notching one yoke lamination deeper and the other yoke lamination shallower than that of adjoining layers. Alternately, the length of the inner leg laminations may be incrementally varied from layer-to-layer to produce a vertical lap joint. In either vertical stepped-lap joint magnetic core structure, the equal length yoke laminations are incrementally shifted in a horizontal direction to form a stepped-lap joint with the leg laminations. It is also known to construct a stepped-lap joint with leg and yoke laminations that incrementally change lengths from layer-to-layer as shown in U.S. Pat. Nos. 3,670,279 and 3,918,153, both assigned to the assignee of the present application. As shown therein, the length of the leg and yoke laminations change in opposite directions from layer-to-layer. The midpoints of the laminations of each leg and yoke portion are aligned thereby incrementally offsetting the ends of the laminations from layer-to-layer to form the desired stepped-lap pattern. This type of magnetic core structure has significantly lower core losses and noise levels compared to magnetic core structures having stepped-lap joints formed by incrementally shifted, equal length leg and yoke laminations.

It would be desirable to provide a magnetic core having stepped-lap joints which exhibits lower losses than prior art magnetic core structures. It would also be desirable to provide a three phase magnetic core having vertical stepped-lap joints between the inner leg and the top and bottom yoke laminations which is symmetrical about the inner leg laminations. Also, it would be desirable to provide a three phase magnetic core formed of unequal length leg and yoke laminations which have their midpoints aligned so as to offset the ends from layer-to-layer. Finally, it would be desirable to provide a three-phase magnetic core formed of unequal length leg and yoke laminations which has a reduced amount of voids between the yokes and the leg laminations and, further, in which the voids are uniformly distributed between the outer leg and the yoke laminations in each group of layers of the laminations.

SUMMARY OF THE INVENTION

Briefly, the present invention discloses a new and improved magnetic core structure of the stacked type having a plurality of stacked groups of layers of magnetic metallic laminations. The magnetic core structure has stepped-lap joints between adjoining leg and yoke portions which are formed by progressively varying the length dimensions of the layers of laminations within each group of laminations of the legs and yokes in opposite directions. The layers of inner leg laminations also have progressively varying lengths, from layer to layer, and are arranged with the midpoints of each lamination aligned to offset the ends of adjacent layers of inner leg laminations in a vertical stepped pattern.

The combination of incrementally varying leg and yoke lamination lengths enables a magnetic core to be constructed with stepped-lap joints in which the voids formed at the inner corners of the magnetic core by the intersection of the leg and the yoke laminations are uniformly distributed between the leg and yoke laminations in each group of layers thereof. This results in a magnetic core which is symmetrical about the inner leg and which has lower losses than prior art magnetic core structures.

BRIEF DESCRIPTION OF THE DRAWING

The various features, advantages, and additional uses of this invention will become more apparent by referring to the following detailed description and the accompanying drawing, in which.

DESCRIPTION OF THE PREFERRED EMBODIMENT

Figure 2:
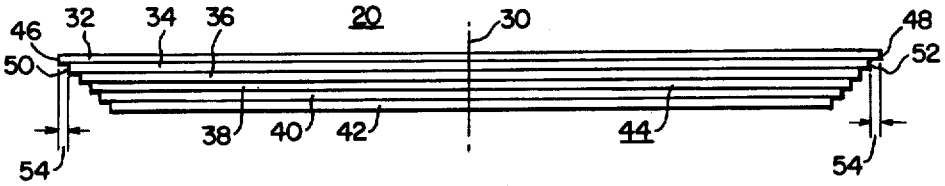
FIG. 2 is a top view showing the stacked laminations of the upper yoke portion of the magnetic core shown in FIG. 1.

Throughout the following description, identical reference numbers refer to the same component or member shown in all figures of the drawing.

Figure 1:
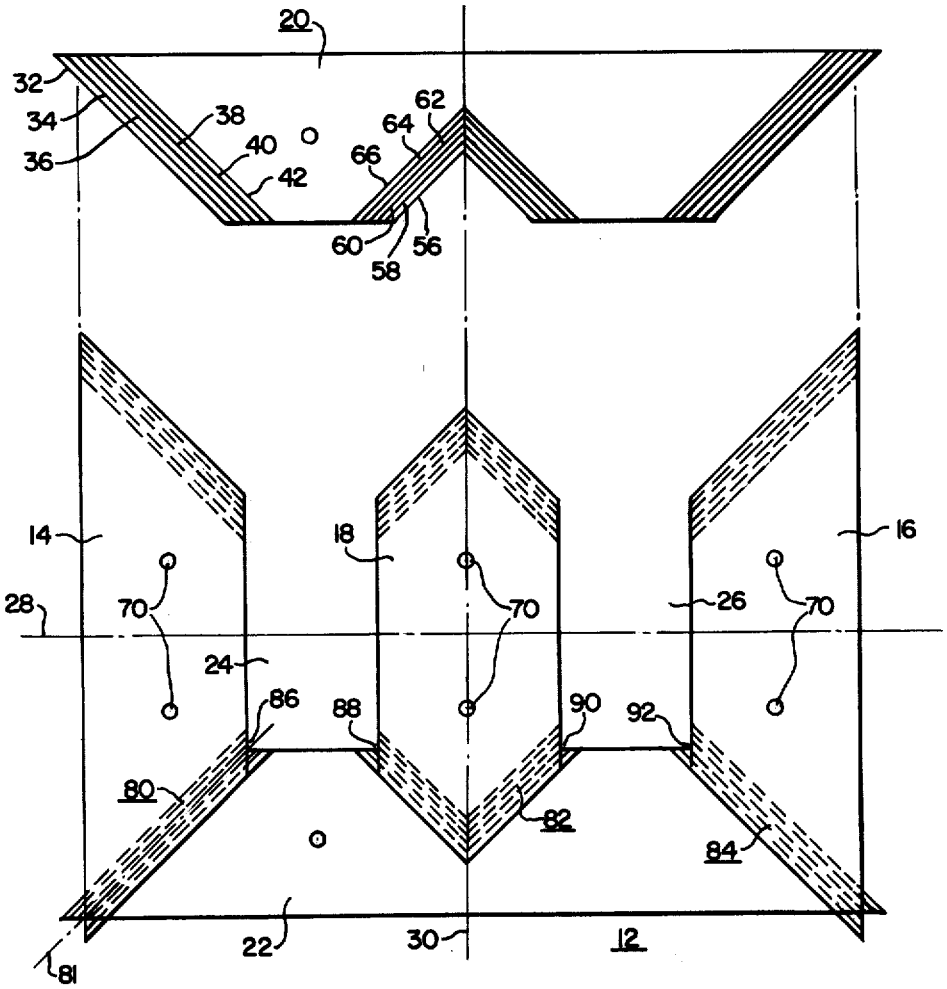
FIG. 1 is a partially exploded, elevational view of a magnetic core structure constructed according to the teachings of this invention.

Referring now to the drawing, and to FIG. 1 in particular, there is shown a magnetic core structure 12 constructed according to the teachings of this invention. Although a three phase magnetic core structure is illustrated in the drawing, it will be understood that the teachings of this invention apply equally as well to single or polyphase magnetic cores of either the shell or core form type.

More specifically, the magnetic core 12 includes first and second outer leg portions 14 and 16, respectively, an inner leg portion 18, and top and bottom yoke portions 20 and 22, respectively. The magnetic core 12 is of the stacked type, with each of the leg and yoke portions being constructed of a stack of metallic laminations formed of suitable magnetic material, such as grain-oriented silicon steel, which has predetermined width dimension and a thickness dimension dependent upon the specific application. Each leg and yoke lamination is formed by a shearing operation which cuts the metallic strip diagonally at predetermined locations to provide outer leg and yoke laminations having a substantially trapezoidal configuration, with the diagonally cut ends forming the non-parallel sides of the trapezoid and the edges of the strip forming the parallel sides of the trapezoid. Magnetic core 12 thus includes a plurality of layers of laminations with the ends of the leg and yoke laminations in each layer being butted together to provide a joint which presents the least reluctance to magnetic flux.

Throughout the following discussion, each layer in the magnetic core 12 is illustrated and described as comprising one lamination of magnetic material. However, it will be understood that the term "layer" is also meant to include a plurality of identically dimensioned, superimposed laminations. Thus, for example, layer 34 in FIG. 2, may include two laminations which have identical length and width dimensions and are superimposed with their ends and edges in alignment.

Magnetic core 12 has stepped-lap type joints between the various leg and yoke portions in which similarly located joints are incrementally offset, from one another, from layer to layer, in a predetermined pattern. The joints between the outer leg portions 14 and 16 and the yoke portions 20 and 22 are mitered, preferably at an angle of 45°, although other angles may also be used, with respect to the sides of the laminations, with the mitered joints being offset from layer to layer in a predetermined stepped-lap pattern. The pattern may step incrementally in one direction only and then return to the starting point to repeat the pattern, or it may incrementally step in both directions, as desired. FIGS. 1 and 2 illustrate a stepped-lap pattern comprised of six layers of laminations which step in one direction with the adjacent six layers returning to the starting point to repeat stepping in the same direction. The use of the term "repeating" with regard to the step pattern is hereafter meant to include both of the aforementioned step patterns. Although the stepped-lap pattern illustrated consists of six layers, as many steps in one direction may be utilized as desired. It has been found that better results are obtained, from the standpoint of efficiency and noise, when more than three steps of layers of laminations are utilized. Thus, six steps in one direction when using a step increment of 3/16 of an inch has been found to be about optimum. Smaller magnetic cores may utilize a step increment of $\frac{1}{8}$th of an inch; while the larger cores may utilize a step increment as great as $\frac{1}{4}$th of an inch.

The laminations of the inner leg portion 18 of the magnetic core 12 also butt against the adjoining yoke laminations with mitered or diagonal joints in order to avoid right angle joints with their higher losses. Thus, each of the ends of each inner leg lamination typically has the configuration of an isosceles triangle. The stepped-lap joint between the inner leg laminations and the yoke laminations is formed by progressively changing the depth of the V-shaped notch into the yoke laminations from layer-to-layer.

The magnetic core 12 is formed of a plurality of groups of superimposed layers of metallic laminations, with each group including six layers of laminations. There is shown in FIG. 1 one group of laminations of the leg portions 14, 16 and 18 and the yoke portions 20 and 22 of the magnetic core 12. The length of each layer of laminations forming the leg and yoke portions of the magnetic core 12 is incrementally varied within each group of layers of laminations. The laminations are stacked in superimposed groups with the six parallel edges in alignment and their midpoints aligned, such as the midpoints of the leg portions 14, 16 and 18 aligned about centerline 28 and the yoke portions 20 and 22 aligned about centerline 30, with the layers of laminations in each group being sequenced according to length. In other words, the shortest lamination is on one side of each group and the longest lamination is on the other side, with the layers between these two laminations progressively increasing in length from shortest to longest. In this manner the ends of each layer of laminations within each group are offset from the ends of the adjacent layer in a stepped pattern. The length of the various layers within each group determines the amount of overlap between the leg and yoke portions of the magnetic core 12 when they are butted together.

Referring now to FIG. 2, there is shown a side view of one group 44 of layers of laminations forming the top yoke portion 20 of the magnetic core 12. The group 44 includes six layers of laminations 32, 34, 36, 38, 40 and 42 which progressively vary in length from the longest lamination 32 to the shortest lamination 42 in a horizontal direction, as viewed in FIG. 1, which is the normal assembly position for a core-form type magnetic core. The midpoints of each lamination 32, 34, 36, 38, 40 and 42 are aligned about centerline 30 which causes the corresponding ends of each lamination to be offset, from layer-to-layer, from the corresponding ends of the adjacent lamination. The amount of offset is purposely exaggerated in FIGS. 1 and 2, relative to the overall sizes of the laminations, to clarify this invention. Thus, ends 46 and 48 of lamination 32 are offset, or extend beyond, the ends 50 and 52 of adjacent lamination 34 by a predetermined amount, as indicated by reference number 54, which determines the amount of overlap between the adjacent layers of the leg and yoke portions at the joints therebetween, as noted hereinbefore. The remaining laminations in group 44 are also offset by amount 54 from the ends of the adjacent laminations.

This step pattern repeats for successive groups of layers of yoke laminations either by returning to the starting point, in which case a lamination having a length identical to that of lamination 32 would be disposed adjacent lamination 42, or by reversing directions, in which case a lamination having a length equal to the length of lamination 42 would be disposed adjacent lamination 42 with succeeding laminations in the adjacent group progressively varying in length therefrom.

Each layer of laminations 32, 34, 36, 38, 40 and 42 of group 44 of the yoke portion 20 further includes a substantially V-shaped notch 56, 58, 60, 62, 64 and 66, respectively, centered about the midpoint of each lamination, as evidenced by centerline 30, to form a stepped-lap joint with the center or inner leg portion 18 of the magnetic core 12. Since the lengths of each group of layers of laminations forming the inner leg portion 18 progressively vary in length across each group, the depth or cut of the notch into the width of each layer 32, 34, 36, 38, 40 and 42 in the top yoke 20, as well as in the corresponding layer in the bottom yoke 22, progressively varies through each group of layers of laminations so as to result in a so-called vertical stepped-lap joint between the inner leg portion 18 and the top and bottom yoke portions 20 and 22, respectively.

According to the teachings of this invention, the top and bottom yoke portions 20 and 22, respectively, are identically formed as hereinbefore described. Similarly, the leg portions 14, 16 and 18 are formed of stacked groups of superimposed layers of laminations having their parallel edges respectively disposed in alignment. Each layer of laminations in each group of laminations of the leg portions 14, 16 and 18 has an incrementally varying length arranged from shortest to longest within each group. The midpoints of each layer of laminations with each group of the leg portions 14, 16 and 18 are respectively aligned, as shown by centerline 28 in FIG. 1, which causes the ends of each layer to be progressively offset from layer-to-layer, from the ends of the adjacent layer in a stepped pattern.

In order to form a stepped-lap joint between the ends thereof, the lengths of the layers of laminations in each group of leg portions 14, 16 and 18 vary oppositely from the lengths of the layers in each group of the yoke portions 20 and 22. That is, the lengths of the layers in the yoke portions 20 and 22 will progressively decrease in length progressing from the bottom to the top of each group of layers, as viewed in FIG. 1, while the lengths of the layers of laminations in each group of the leg portions 14, 16 and 18 will increase from the bottom to the top of each group.

In constructing the magnetic core 12, the leg portions 14, 16 and 18, each consisting of a plurality of stacked groups of superimposed layers of laminations, which may be prestacked and banded together, are positioned in a suitable fixture. The various layers of laminations are maintained in the desired stepped arrangement by means of circular openings 70 which extend through each lamination and which, when aligned, provide the desired stepped configuration between the ends of the layers of laminations of the leg portions 14, 16 and 18. The bottom yoke portion 22 is then inserted, at least one group of laminations at a time, to butt against the lower edges of the leg portions 14, 16 and 18. In a core-form type structure, the assembly is then uprighted to a vertical position and the windings installed around the legs before the top yoke position 20 is inserted to butt against the upper edges of the leg portions 14, 16 and 18. Since, in a shell-form type construction, the core is stacked around the windings, assembly of both the top and bottom yoke portions takes place in a horizontal orientation, as shown in FIG. 1.

In either type of construction, the various groups of layers of laminations of the top and bottom yoke portions 20 and 22, respectively, are butted against the corresponding edges of the layers of laminations of the leg portions 14, 16 and 18 to form stepped-lap joints therebetween, such as joints 80, 82 and 84 between the leg portions 14, 16 and 18 and the bottom yoke portion 22, shown in FIG. 1. Similar joints will also be formed between the leg portions 14, 16 and 18 and the top yoke portion 20. As shown in FIG. 1, small voids are formed between the adjoining ends of corresponding leg and yoke laminations at the inner corners 86, 88, 90 and 92 of the magnetic core 12. Although the voids can be eliminated by forming each lamination to the necessary complex shape by a die cutting operation, such a procedure is costly and time consuming. A magnetic core constructed according to the teachings of this invention enables the laminations to be formed by an inexpensive shearing operation and, by minimizing void volume and uniformly distributing the voids across the joint in each group of laminations, reduces core losses and noise levels to levels below that of prior art magnetic cores having stepped-lap joints. A symmetrical joint is achieved by disposing the leg and yoke laminations at predetermined locations relative to their diagonally cut ends such that the voids formed at the inner corners 86, 88, 90 and 92, in FIG. 1, by the intersection of the leg and yoke laminations are uniformly distributed between the leg and yoke laminations in each group of layers of laminations. Thus, in the magnetic core shown in FIG. 1, the voids formed between the adjoining ends of the bottommost three layers of laminations of the leg 14 and yoke 22 at inner corner 86 will be located to the left side of the diagonal centerline 81 through the joint 80 and will lie entirely within the layers of laminations forming the leg 14. Similarly, the voids formed between the adjoining ends of the uppermost three layers of laminations of the leg 14 and yoke 22 at inner corner 86, will be located within the yoke portion 22 of the magnetic core 12. In each group of layers of laminations, the voids are uniformly distributed on either side of the joint between the leg and yoke laminations which provides a symmetrical joint and reduces core losses to levels below that of prior art magnetic cores having stepped-lap joints between leg and yoke laminations which progressively vary in length.

More specifically, it has been found that a magnetic core structure 12 constructed as described above has about 12% less destruction factor than prior art stepped-lap magnetic core structures in which the laminations are progressively offset at their midpoints. In addition, the edges of the yoke and outer leg laminations can be cut to the desired shape by a shearing operation instead of the more expensive die cut operation utilized in certain prior art magnetic core structures to minimize the void volume.

Figure 3:
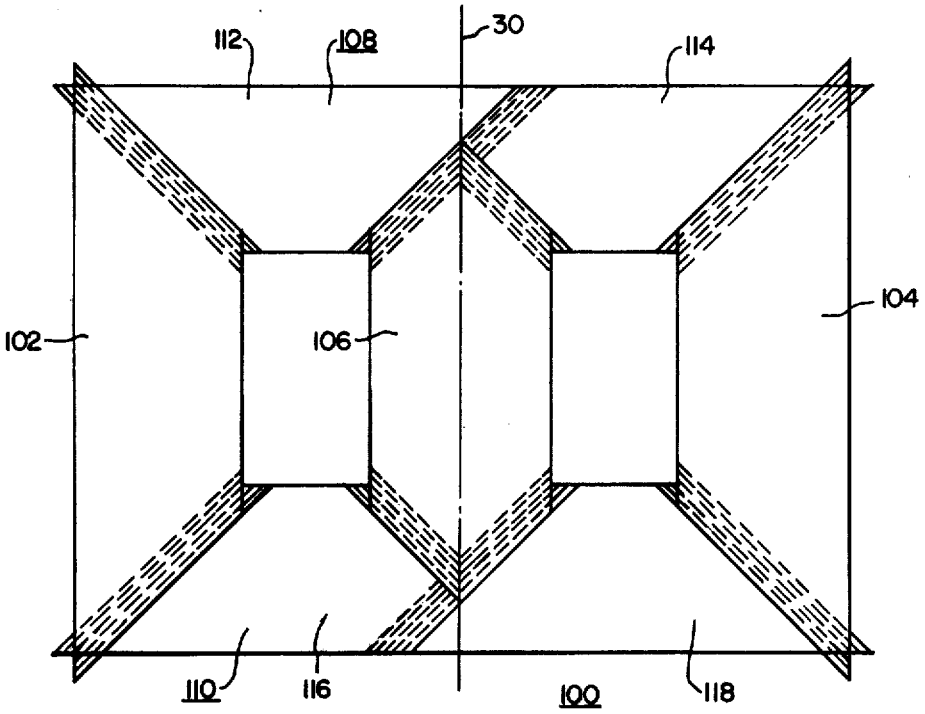
FIG. 3 is an elevational view of another embodiment of a magnetic core structure constructed according to the teachings of this invention.

Referring now to FIG. 3, there is shown a magnetic core structure 100 constructed according to another embodiment of this invention. The magnetic core structure 100 includes outer leg portions 102 and 104, respectively, inner leg portion 106, and top and bottom yoke portions 108 and 110, respectively. The outer leg portions 102 and 104, the inner leg portion 106, and the top and bottom yokes 108 and 110 are constructed identically to that shown in FIG. 1 and include layers of laminations of progressively varying lengths which are disposed with their ends incrementally offset from corresponding ends in adjacent layers to form a stepped-lap joint configuration. As shown in FIG. 3, each layer of laminations in the top and bottom yoke portions 108 and 110, respectively, consists of two pieces, such as yoke pieces 112 and 114 in the top yoke portion 108 and pieces 116 and 118 in the bottom yoke portion 110, which are butted together to form the individual yoke portions. This construction is advantageous for large power transformers in which a single piece yoke construction would be too large to conveniently handle during the assembly of the magnetic core structure. As with the top and bottom yoke structure illustrated in FIG. 1 and described above, the individual pieces making up each layer of the yokes, such as pieces 112 and 114 of the top yoke portion 108, have progressively varying lengths from layer to layer with the ends being incrementally offset from the corresponding ends of adjacent layers to form the desired stepped-lap joint with the outer leg portions 102 and 104 of the magnetic core structure 100.

In summary, there has been disclosed herein a new and improved magnetic core structure of the stacked type. The magnetic core structure has stepped-lap joints between adjoining leg and yoke portions which are formed by progressively varying the length dimensions of the layers of laminations within each group of laminations of the legs and yokes in opposite directions. The layers of inner leg laminations within each group are of varying lengths with the ends being incrementally offset from the corresponding ends in the adjacent layers to form a vertical stepped-lap joint configuration. The combination of varying length leg and yoke laminations results in a magnetic core structure having stepped-lap joints which is symmetrical about the inner leg. Further, the voids between the butting edges of the top and bottom yoke laminations and the leg laminations of the magnetic core structure are symmetrically distributed between the yokes and legs at each corner of the magnetic core within each group of layers of laminations which provides a magnetic core structure having lower losses than prior art magnetic core structures having stepped-lap joints. More particularly, the void volume in the magnetic core structure disclosed herein is symmetrically distributed across each joint between the leg and yoke laminations within each group of layers of laminations which results in less core losses than that provided by prior art type magnetic cores having unequal length leg and yoke laminations in which the void volume is uniformly distributed between several groups of laminations.

What is claimed is:

1. A magnetic core comprising:

a plurality of stacked groups of layers of metallic laminations, each of said groups including a plurality of said layers;

each of said layers including first and second outer leg laminations and an inner leg lamination, each having first and second ends, and first and second yoke laminations forming a magnetic core having said outer and inner leg laminations connected by said yoke laminations and a plurality of outer and associated inner corners;

said yoke and said leg laminations having their ends cut diagonally to provide a closed magnetic circuit having diagonal joints between adjoining ends of said yoke and leg laminations;

the length dimensions of said outer and inner leg laminations and said first and second yoke laminations progressively varying in opposite directions from layer to layer within each group, while the respective midpoints of each leg and yoke lamination are aligned to offset said diagonally cut ends of said leg and yoke laminations from layer to layer in a stepped pattern that progresses at least three steps in one direction;

the relative locations of said leg and yoke laminations in the direction of their diagonal cut ends being selected to divide the voids formed at said inner corners of said magnetic core by the intersection of said leg and yoke laminations uniformly between said leg and yoke laminations in each group of layers of laminations.

2. The magnetic core of claim 1 wherein each layer of at least one of the first and second yoke portions is formed of first and second members disposed in butting relationship, with the length dimensions of each of said first and second members progressively varying from layer to layer, while the midpoints are aligned, to offset the ends of said first and second members from layer to layer to form a predetermined stepped pattern which progresses at least three steps.

* * * * *